US006725590B1

(12) United States Patent
Slusher

(10) Patent No.: US 6,725,590 B1
(45) Date of Patent: Apr. 27, 2004

(54) PERSONAL IDENTIFICATION PANEL FOR BIKE

(75) Inventor: Mike Slusher, 2911 Brookshire Dr., Grapevine, TX (US) 76051

(73) Assignee: Mike Slusher, Grapevine, TX (US)

( * ) Notice: Subject to any disclaimer, the term of this patent is extended or adjusted under 35 U.S.C. 154(b) by 0 days.

(21) Appl. No.: 10/365,175

(22) Filed: Feb. 12, 2003

Related U.S. Application Data

(60) Provisional application No. 60/357,596, filed on Feb. 15, 2002.

(51) Int. Cl.[7] ..... G09F 21/04

(52) U.S. Cl. ..... 40/590; 40/587; 40/594; 40/630; 40/672

(58) Field of Search ..... 40/590, 587, 594, 40/625, 628, 630, 672

(56) References Cited

U.S. PATENT DOCUMENTS 1,182,753 A * 5/1916 Clencie ..... 40/587
3,820,852 A * 6/1974 Kennedy ..... 40/587
3,887,268 A * 6/1975 Golden et al. ..... 40/613
5,246,517 A * 9/1993 Watson ..... 40/594
5,349,470 A * 9/1994 Alexander ..... 40/587
5,619,815 A * 4/1997 Greene ..... 40/587

* cited by examiner

*Primary Examiner*—Gary Hoge
(74) *Attorney, Agent, or Firm*—Wendy Buskop; Buskop Law Group, P.C.

(57) ABSTRACT

The invention is a personal identification panel for vehicles having at least one wheel with at least two spokes made of a rigid personal identification panel area with a thickness of $1/32^{th}$ having a first side, a second side, a first attachment end for folding over the first spoke, a second attachment end for folding over the second spoke, a first adhesive strip and a second adhesive strip disposed on the first side and on the first attachment end, wherein the first adhesive strip is proximate to the second adhesive strip and the first adhesive strip secures to the second adhesive strip, and a third adhesive strip and a fourth adhesive strip disposed the first side and on the second attachment end, wherein the third adhesive strip is proximate to the fourth adhesive strip and the third adhesive strip secures to the fourth adhesive strip.

19 Claims, 11 Drawing Sheets

PERSONAL IDENTIFICATION PANEL FOR BIKE

The present application claims priority to Pending patent application Ser. No. 60/357,596 filed in the U.S. Patent and Trademark Office on Feb. 15, 2002.

FIELD OF THE INVENTION

This invention generally relates to a personal identification device that can be easily installed around the spokes of a bicycle wheel or any wheel having spokes.

More specifically, the present invention relates to a device that can be permanently affixed to a bicycle which has serial numbers, names, or other personal identification information between the spokes.

BACKGROUND OF THE INVENTION

A need has long existed for a personal identification device for vehicle to help customize a vehicle to the taste of the individual. The present invention meets this need.

Bicycling is becoming an increasingly more popular form of recreation as well as a means of transportation. Moreover, bicycling has become a very popular competitive sport for both amateurs and professionals. Whether the bicycle is used for recreation, transportation or competition, the bicycle industry is constantly improving the various components of the bicycle. This has resulted in many different types of bicycle wheels with different sizes and spoke orientations, different numbers of spokes, shapes of the spokes and other things. Racers use fewer spokes in order to decrease wind resistance. Small children have bicycles with more spokes.

Frequently, small children will loose their bicycles on a playground, as many bicycles look the same. The present invention is designed to help identify, at a distance, using personal names, or number, or other personal indicia, a bicycle as belonging to a specific child.

A relatively conventional wheel has thirty-six spokes, with adjacent spokes intersecting each other at approximately 27.degrees. Such spokes are typically approximately two millimeters in diameter. More recently, bicycle wheels have been designed with fewer spokes to improve the performance of the bicycle wheel. For example, bicycle wheels have been developed with sixteen spokes. A bicycle wheel with sixteen spokes typically has its spokes intersecting at approximately 54 degrees.

One problem common among any form of bicycle or wagon with wheel spokes, or other device with spokes is the lack of space to notate ownership of the vehicle.

A need has long existed for a device which can be used particularly on children's bicycles which is durable, difficult to remove and capable of providing the name of the child which can easily be read when the wheel is not rotating. A need has long existed for such a device which is adaptable to different wheel sizes, to different spoke configurations, and can be used without harming the ability to ride the bicycle.

In view of the above, there exists a need for a device which overcomes the above mentioned problems in the prior art. This invention addresses this need in the prior art as well as other needs, which will become apparent to those skilled in the art from this disclosure.

SUMMARY OF THE INVENTION

The invention relates to a personal identification panel for vehicle having at least one wheel with spokes. The personal identification panel has two sides, a first attachment end for folding over the first spoke, and a second attachment end for folding over the second spoke. The rigid personal identification panel area has a thickness of $1/32^{th}$ inch and at least four adhesive strips.

The invention also relates to a personal identification panel for vehicle having at least one wheel having a first spoke and a second spoke, wherein the personal identification panel has a fold formed in said rigid display, wherein said rigid display wraps around the second spoke, in the direction of wheel rotation. The rigid personal identification panel area has a thickness of $1/32^{th}$ inch and at least four adhesive strips.

Finally, the invention also relates to a personal identification panel for a vehicle having at least one wheel having a two spokes. The rigid display support has a first support end and a second support end, a first support side, a second support side. The rigid display support also has a thickness of $1/32^{th}$ inch and adhesive strips disposed on the support sides.

The invention particularly relates to a device for use with a bicycle.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

A specific embodiment of the invention will be described by way of example with reference to the accompanying drawings, in which.

The present invention is detailed below with reference to the listed Figures.

DETAILED DESCRIPTION OF THE PREFERRED EMBODIMENTS

Before explaining the present invention in detail, it is to be understood that the invention is not limited to the particular embodiments and that it can be practiced or carried out in various ways.

Figure 1:
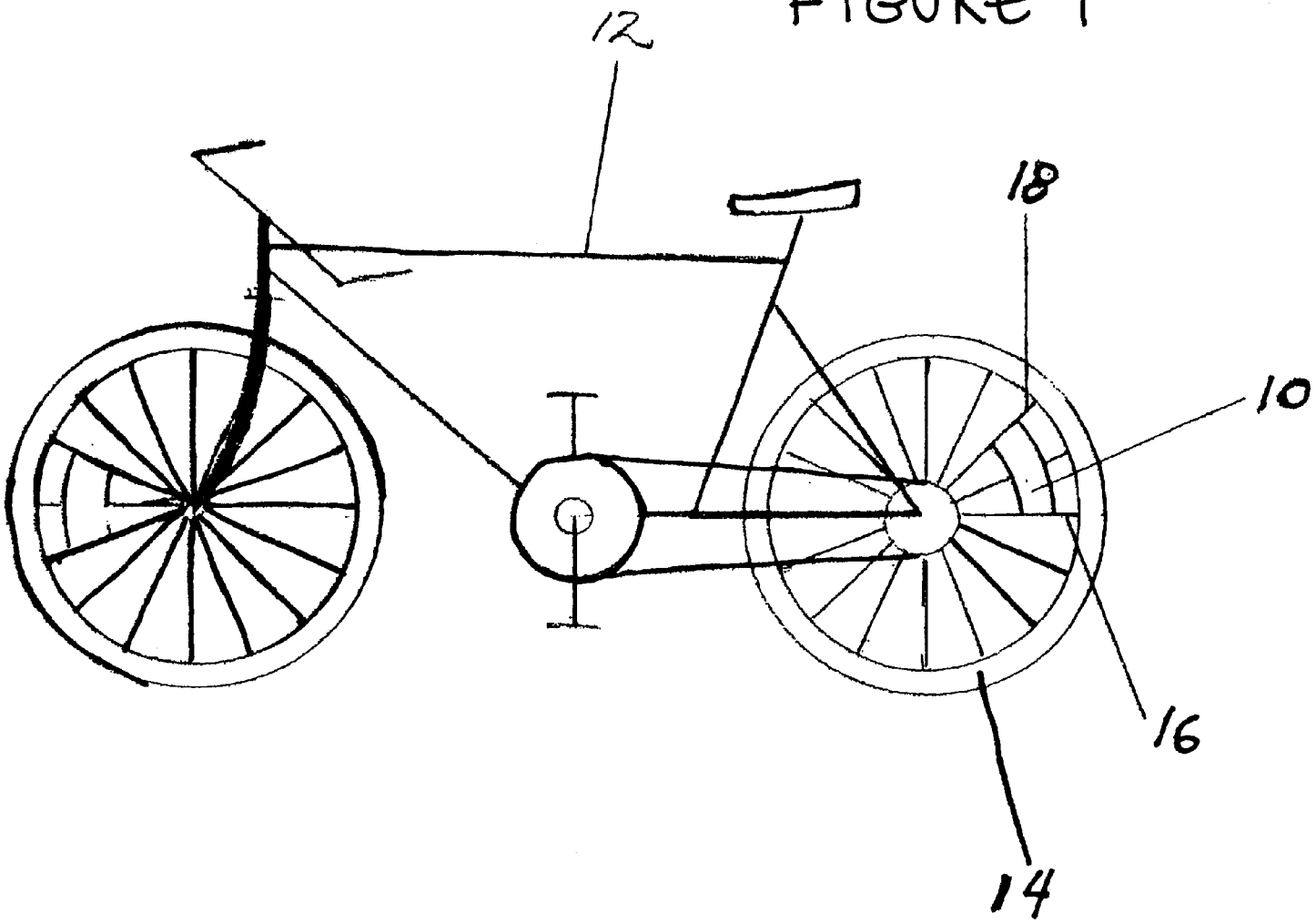
FIG. 1 is a bicycle with the invention attached.

Referring to FIG. 1, the present invention is a personal identification panel 10 for a vehicle 12 having at least one wheel 14, a first spoke 16, and a second spoke 18.

Figure 2:
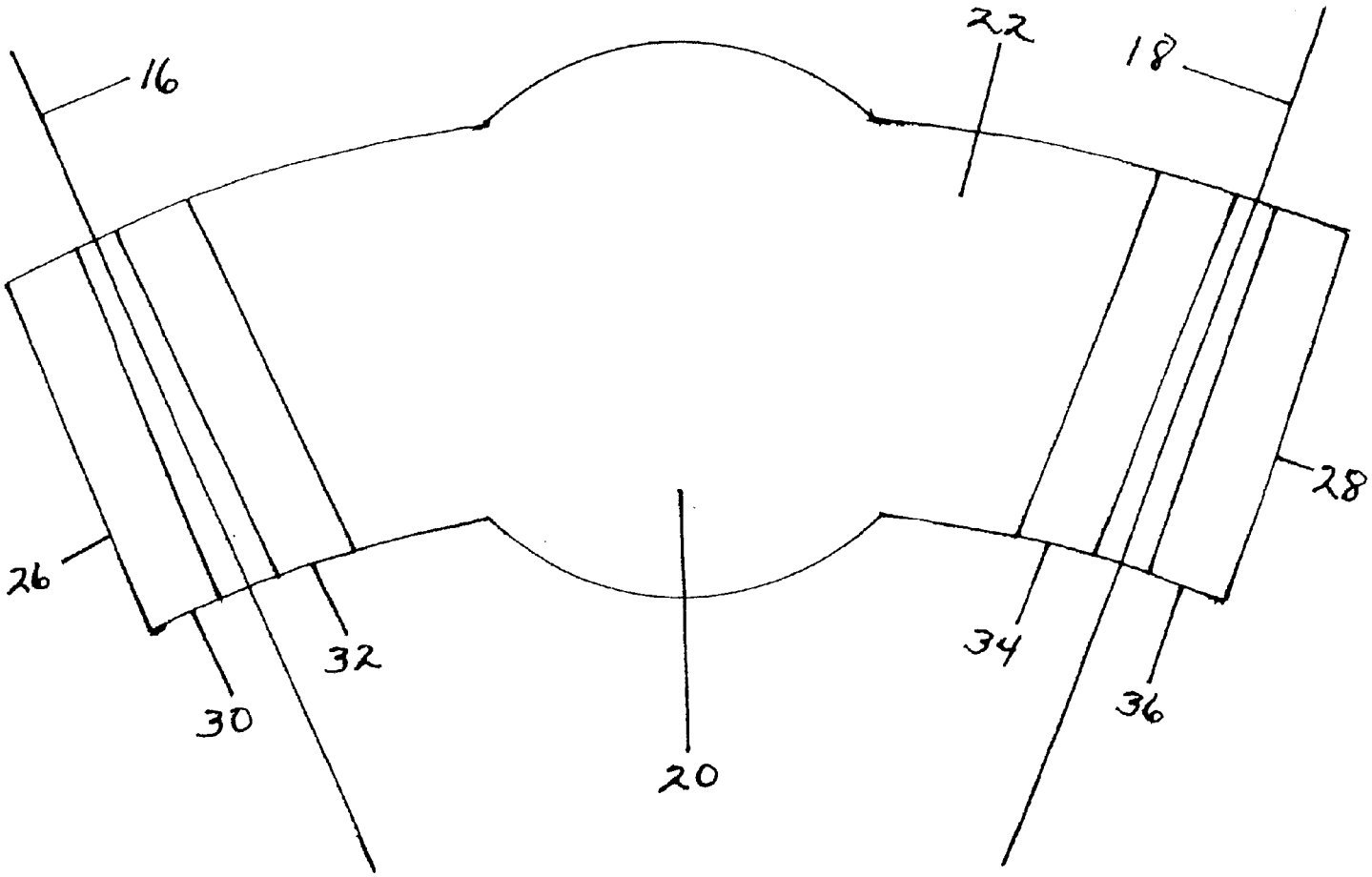
FIG. 2 is a top view of the invention.
Figure 3:
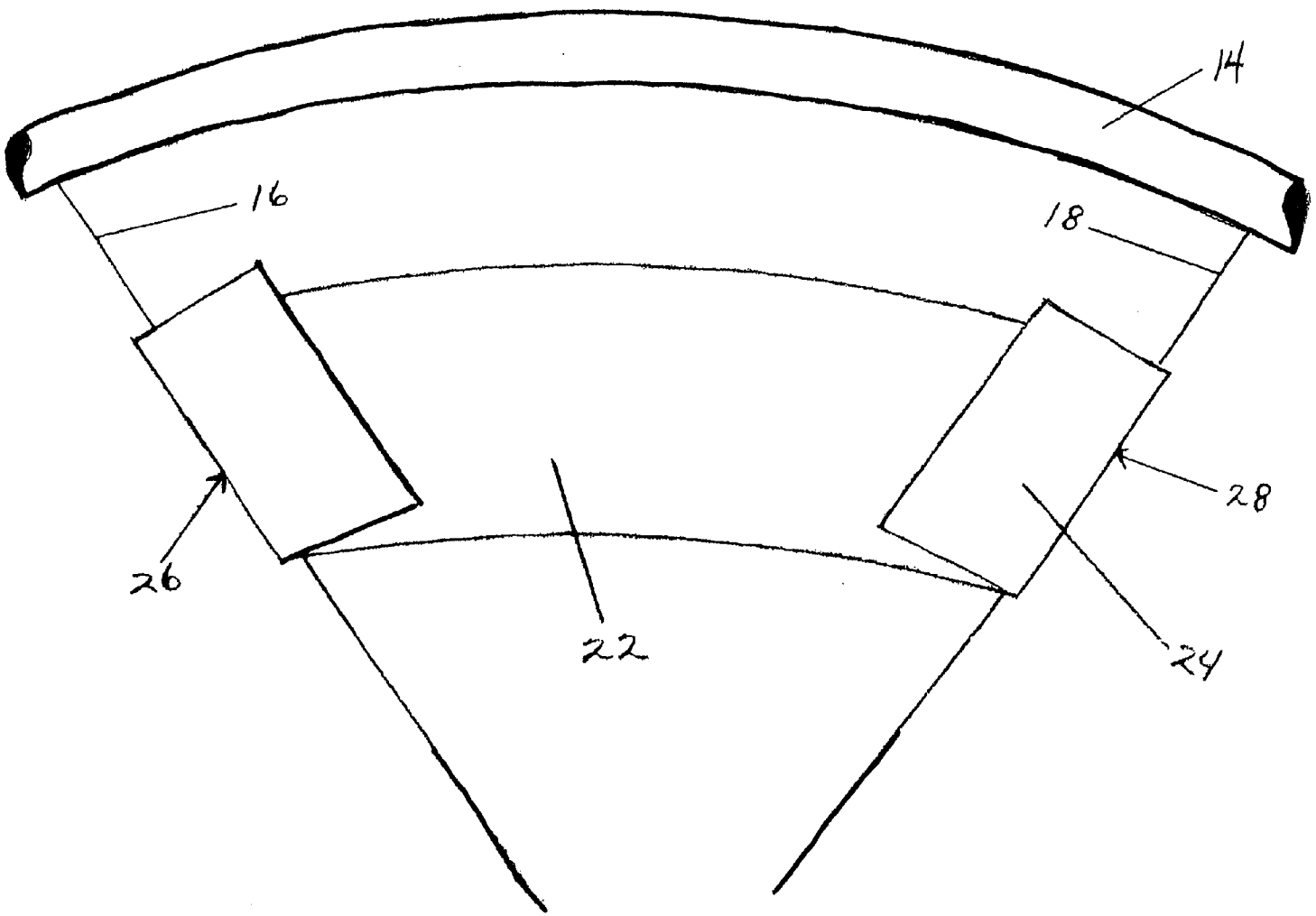
FIG. 3 shows a perspective view of the folded invention.

FIG. 2 shows the invention has a rigid personal identification panel area 20 having a first side 22 and a second side 24, as shown in FIG. 3. Returning to FIG. 2, a first attachment end 26 for folding over the first spoke 16 and a second attachment end 28 for folding over the second spoke 18. The rigid personal identification panel area 20 has a thickness of $1/32^{th}$ inch.

FIG. 2 also shows a first adhesive strip 30 and a second adhesive strip 32 disposed on the first side 22 and on the first attachment end 26, and a third adhesive strip 34 and a fourth adhesive strip 36 disposed the first side 22 and on the second attachment end 28. The first adhesive strip 30 is proximate to the second adhesive strip 32, and the third adhesive strip 34 is proximate to the fourth adhesive strip 36. In this embodiment, the first adhesive strip 30 secures to the second adhesive strip 32, around spoke 16 and the third adhesive strip 34 secures to the fourth adhesive strip 36, around spoke 18.

The vehicle on which the invention can be used can be a bicycle, tricycle, unicycle, baby carriage, trailer, motorcycle, scooter, shopping cart, or wagon.

The personal identification panel most preferably has a length between 4 inches and 13 inches, and a width of between 3.5 inches and 5 inches.

For wheels that range in diameter from 26 to 27 inches the personal identification panel can have 12.57 inch length and a width of 3.5 inches.

For wheels that have a diameter of 24 inches, the personal identification panel can have an 11 inch length and a width of 3 inches.

For wheels that range in diameter from 16 to 20 inches, the personal identification panel has an 8 inch length and a width of 2.5 inches.

In a preferred embodiment shown in FIG. 2, the rigid personal identification panel area 20 is circular, however the rigid personal identification panel area 20 can be crescent shaped and have between a 30 and 90 degree arc.

In another preferred embodiment, the rigid personal identification panel area has a 60 degree arc.

The rigid personal identification panel area 20 can be sheet plastic and utilize an adhesive that has a holding power of at least one lb per square inch, and withstand shear of up to 60 pounds per square inch.

Preferably the rigid personal identification panel area is polypropylene, Mylar, or an acrylic.

The adhesive of adhesive 30, 32, 34, and 36 can be a two sided adhesive tape capable of supporting at least one pound per square inch.

The personal identification panel can have pigment disposed on the surface of the first side 22, or only on top of the rigid personal identification panel area 20.

Figure 8:
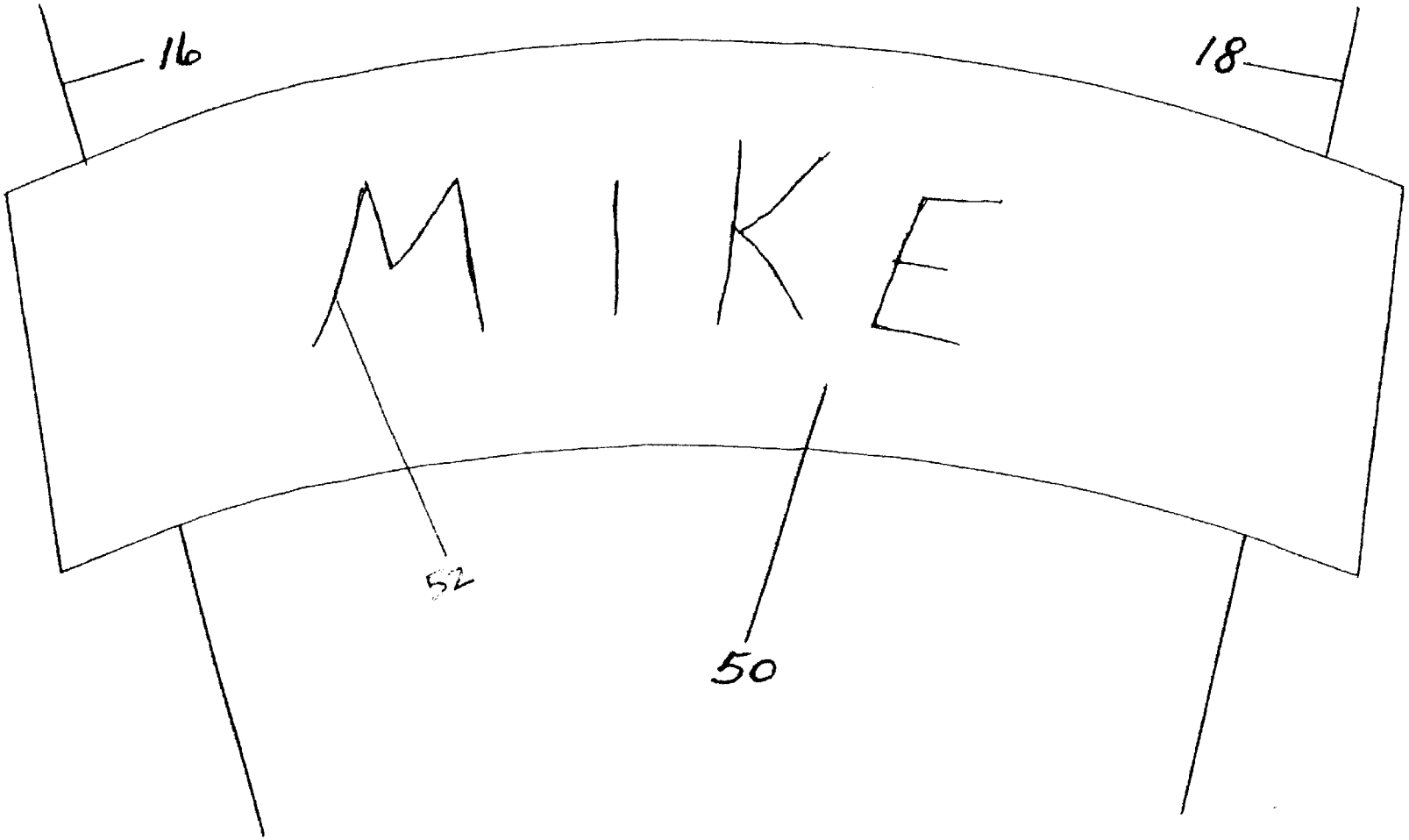
FIG. 8 shows the front view of the invention.

Preferably, the pigment can be in the form of letter or logos. FIG. 8 depicts the pigment 52 in the form of letters to show the name "MIKE". The pigment can be a phosphorescent, fluorescent, luminescent, or opaque pigment. The pigment can be embedded in the sheet plastic; however, additional pigment can be disposed on the sheet plastic or rigid personal identification panel area 20.

In another embodiment the adhesive strips can be square patches.

FIG. 3 shows the invention preferably with a first side 22 and a second side 24, a first attachment end 26 for attachment to the first spoke 16 and a second attachment end 28 for attachment to the second spoke 18 of wheel 14.

Figure 4:
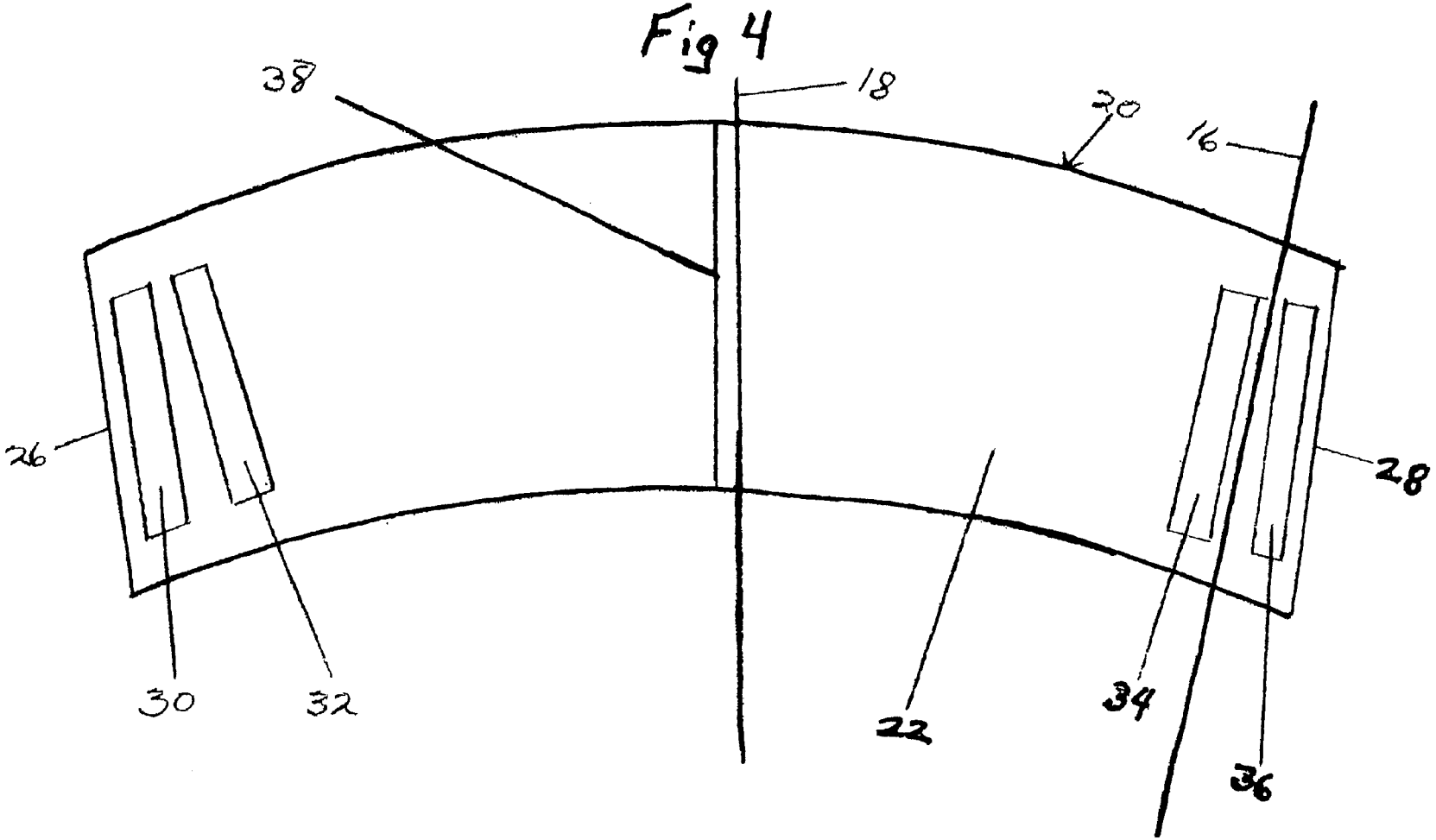
FIG. 4 shows another view of the invention.

FIG. 4 provides a detail of the invention that shows a first adhesive strip 30 and a second adhesive strip 32 that is disposed on the first side 22 and on the first attachment end 26. A third adhesive strip 34 and a fourth adhesive strip 36 are disposed on the first side 22 is proximate to each other on the second attachment end 28.

The first attachment end 26 of the rigid personal identification panel area 20 folds around second spoke 18 over the first spoke 16 and secures the first and second adhesive strips 30 and 32 to the third and fourth adhesive strips 34 and 36, such that the second spoke 18 nestles within the fold 38.

Figure 5:
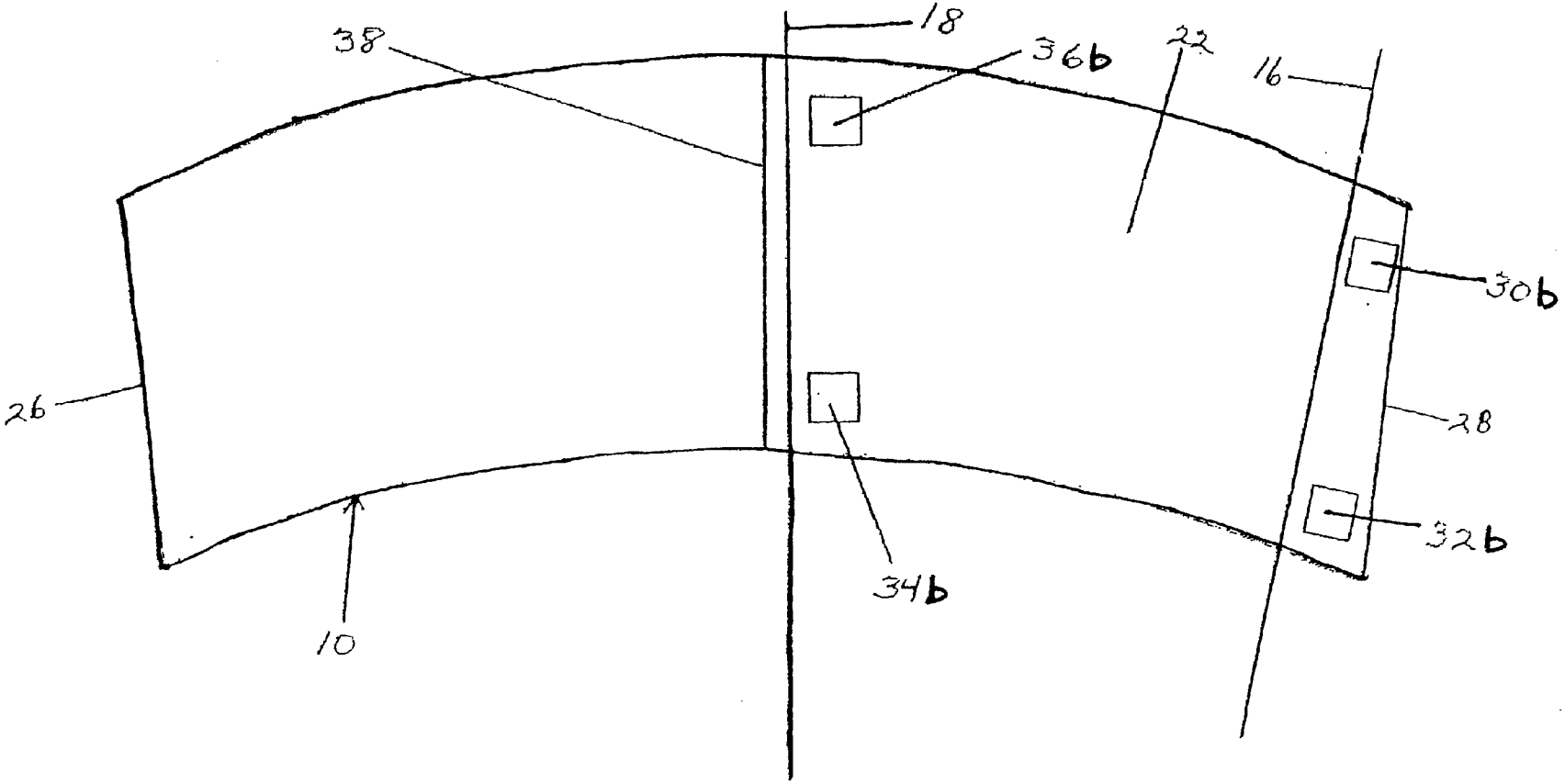
FIG. 5 shows another view of the invention.

Referring to FIG. 5, which provides another embodiment of the personal identification panel 10. The rigid personal identification panel area wraps around the second spoke 18 in the direction of wheel rotation. The first attachment end 26 wraps over spoke 18 forming fold 38 and securing it to the first adhesive strip 30*b*, the fourth adhesive strip 36*b*, the second adhesive strip 32*b*, and the third adhesive strip 34*b*. The first spoke 16 is disposed between the first adhesive strip 30*b* and the fourth adhesive strip 36*b*, and between the second adhesive strip 32*b* and the third adhesive strip 34*b*. The adhesive strips in this embodiment are square.

Figure 6:
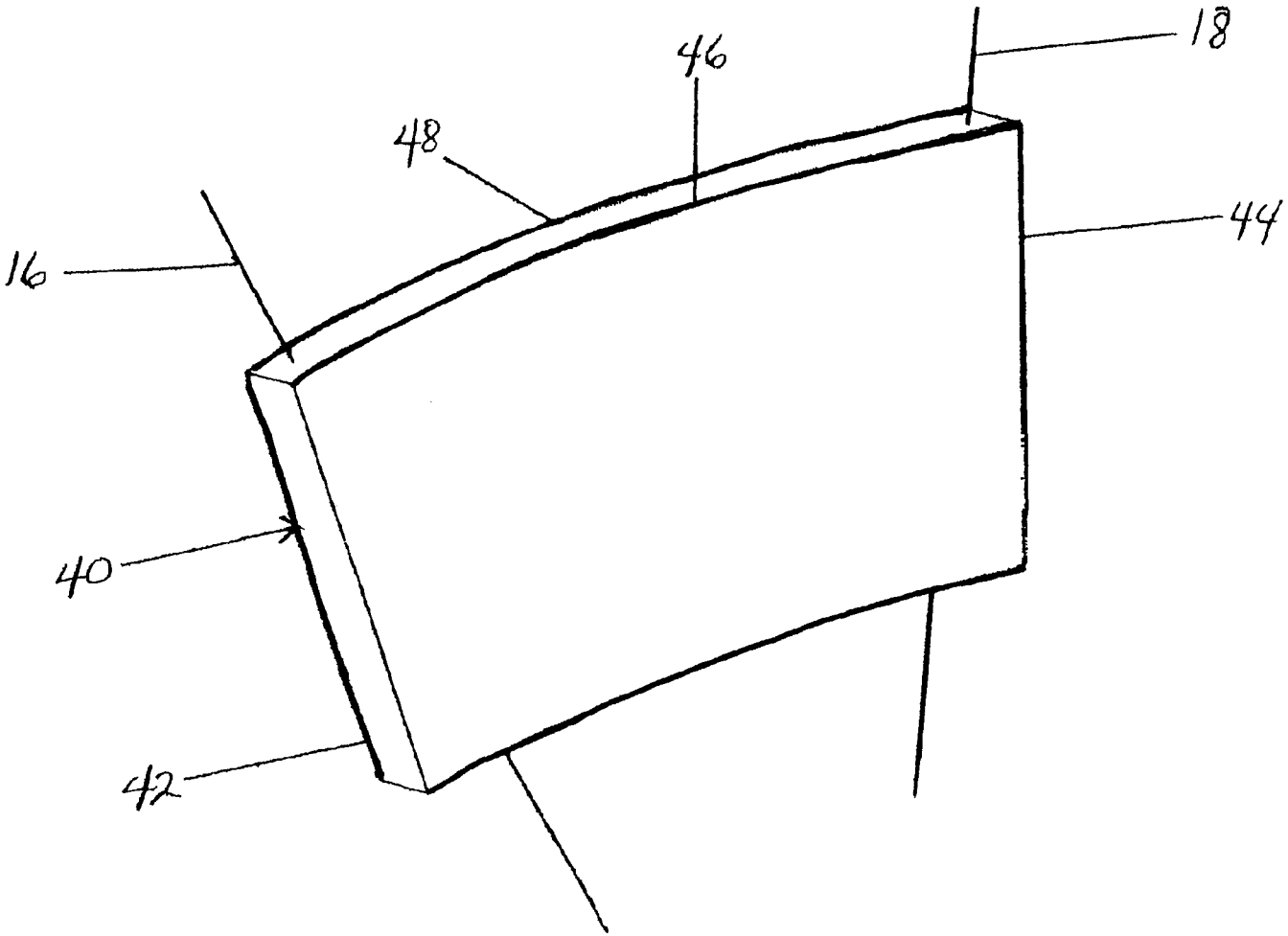
FIG. 6 shows a perspective view of the invention attached to two spokes.
Figure 6A:
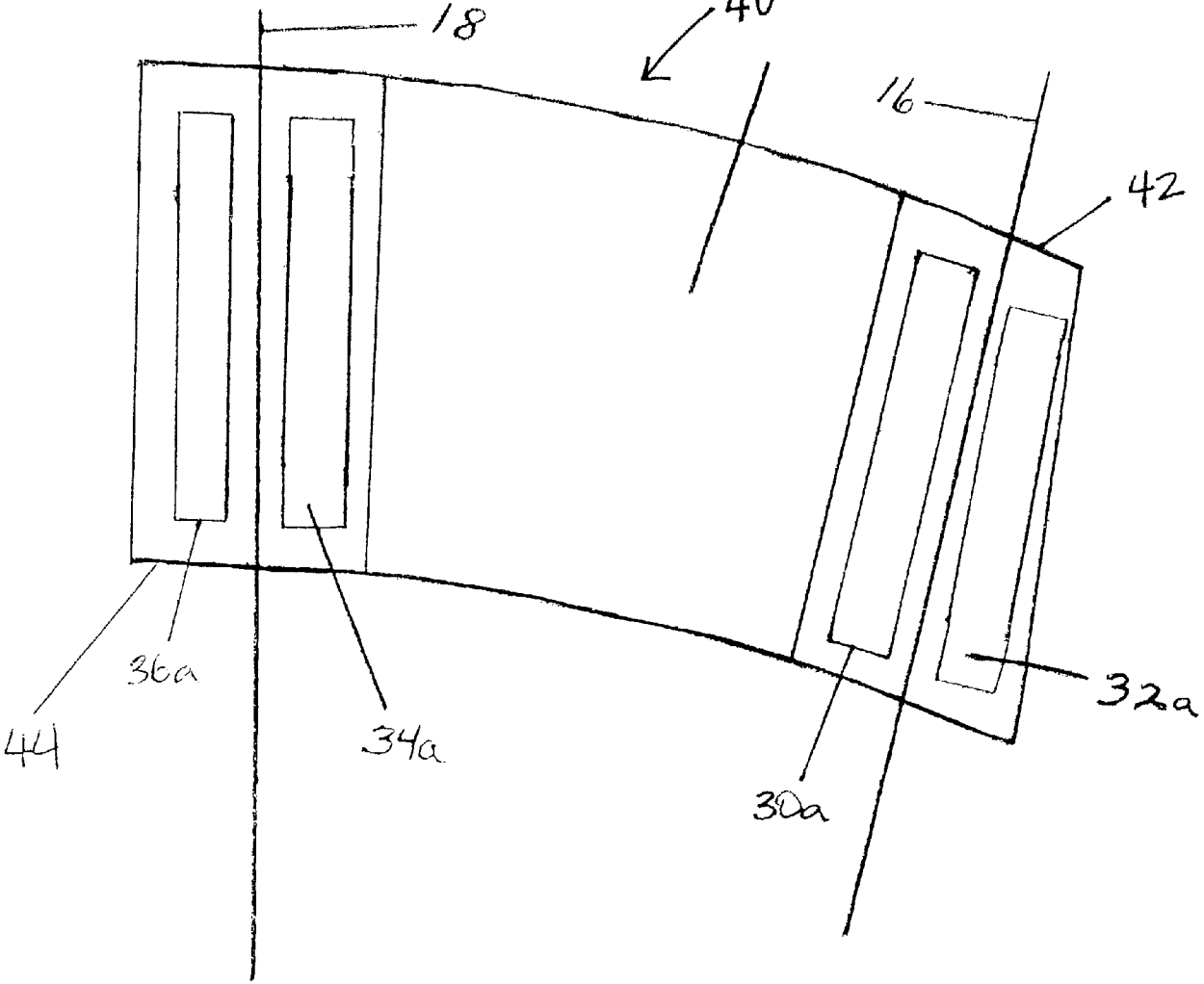

As shown in FIG. 6, a rigid display support 40 preferably has a first support end 42, a second support end 44, a first support side 46, and a second support side 48. Spokes 16 and 18 are contained within the rigid display support 40.

Figure 7:
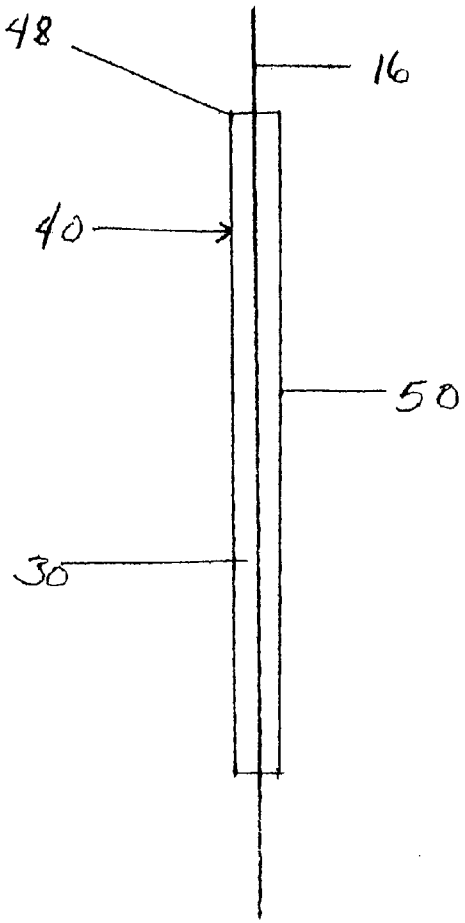
FIG. 7 shows the end view of the invention.

FIG. 7 shows the embodiment of FIG. 6, wherein the rigid display support 40 has a rigid display top 50, which attaches to the rigid display support 40, forming a laminate. Preferably, the first spoke 16 is disposed between the first adhesive strip 30 and the second adhesive strip 32 (not shown in this Figure), and between the rigid display top 50 and a second support 48. The rigid display support 40, and the second spoke 18 is disposed between the third and fourth adhesive strips, between the rigid display top 50 and the rigid display support 40.

Figure 9:
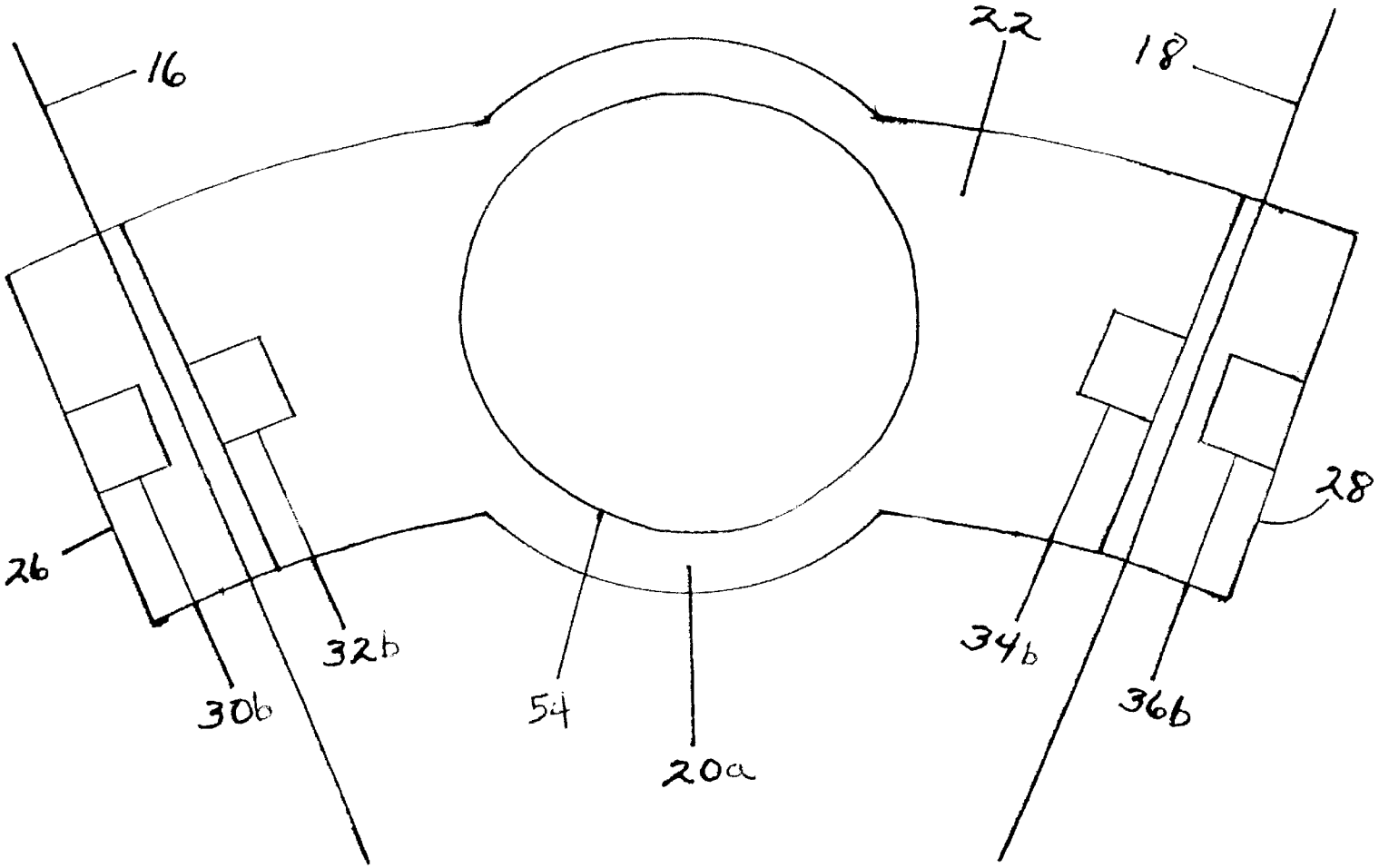
FIG. 9 depicts the invention having a rigid display support.
Figure 10:
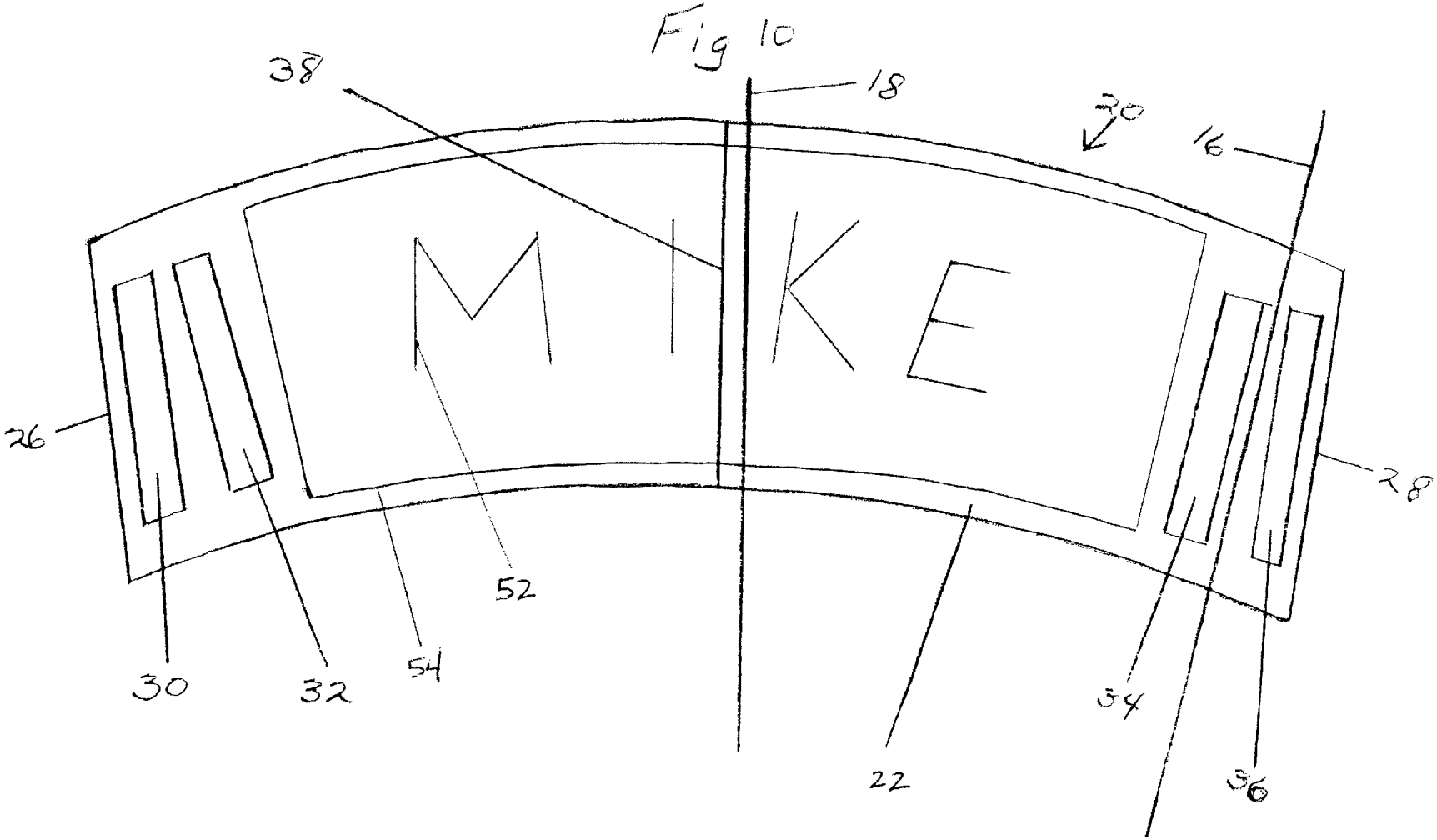
Figure 1:
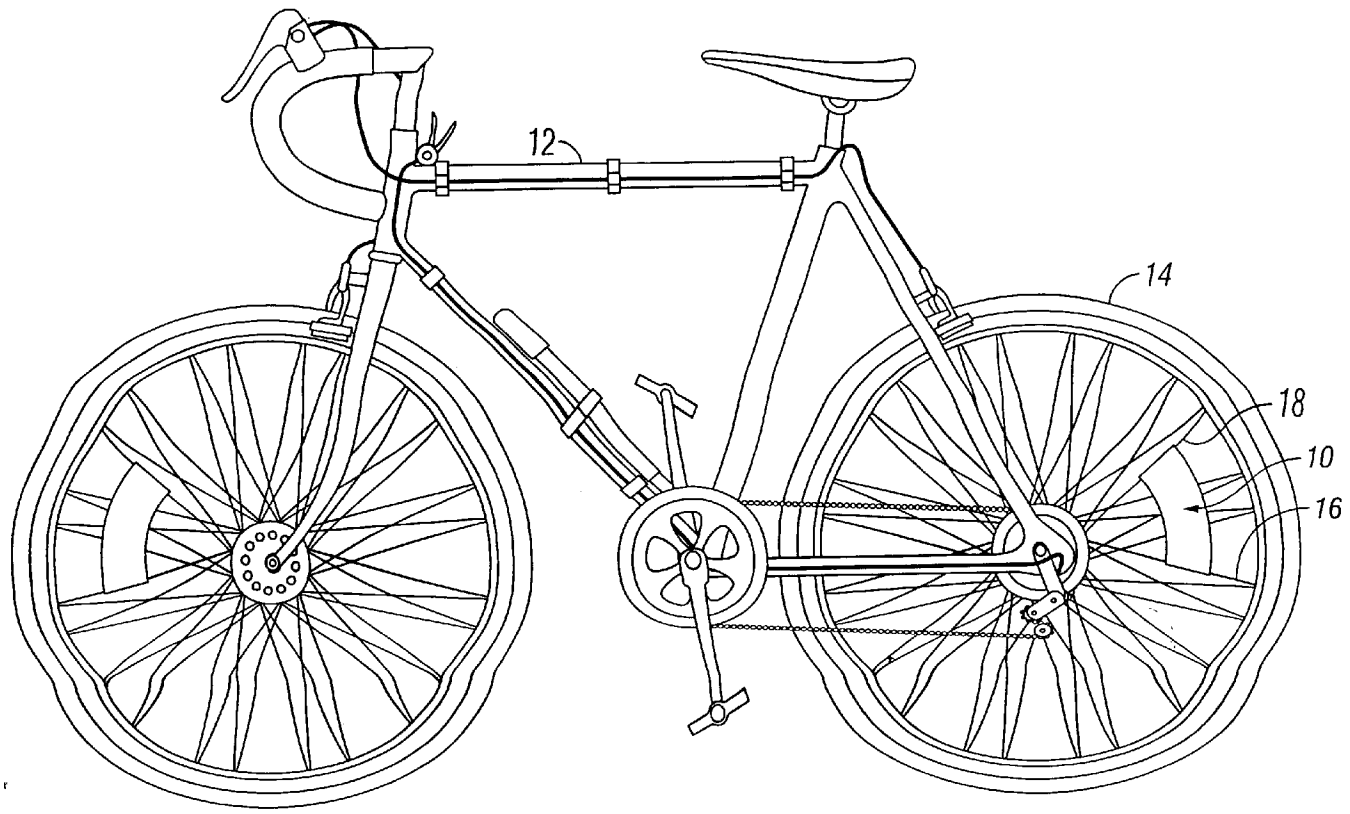
Figure 2:
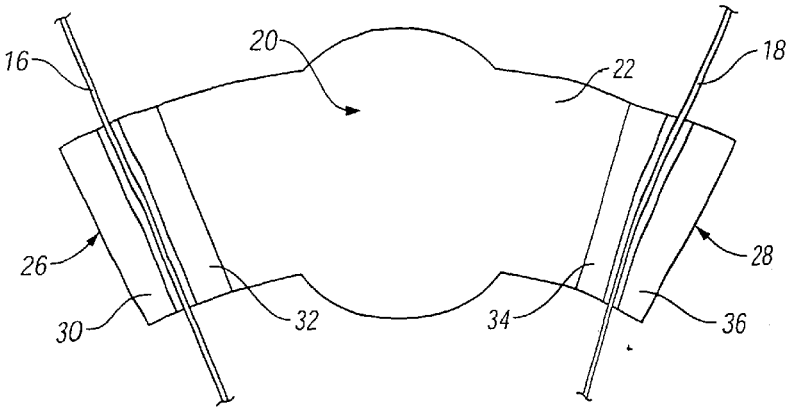
Figure 3:
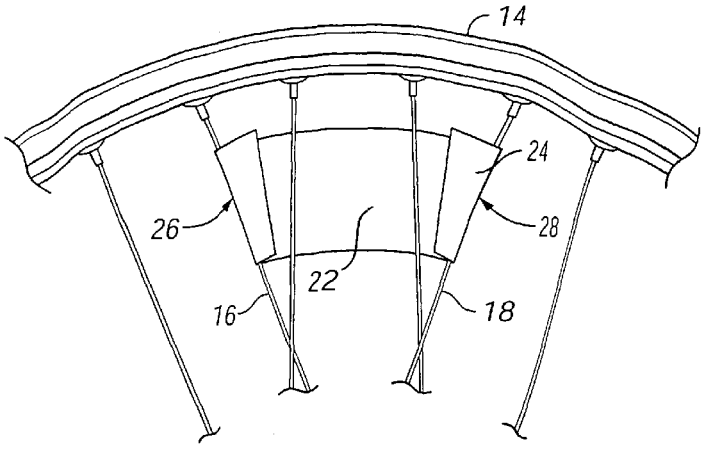
Figure 4:
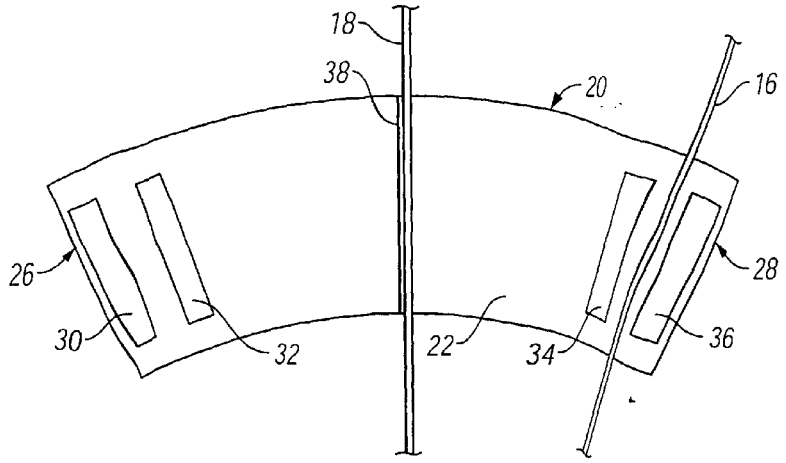
Figure 5:
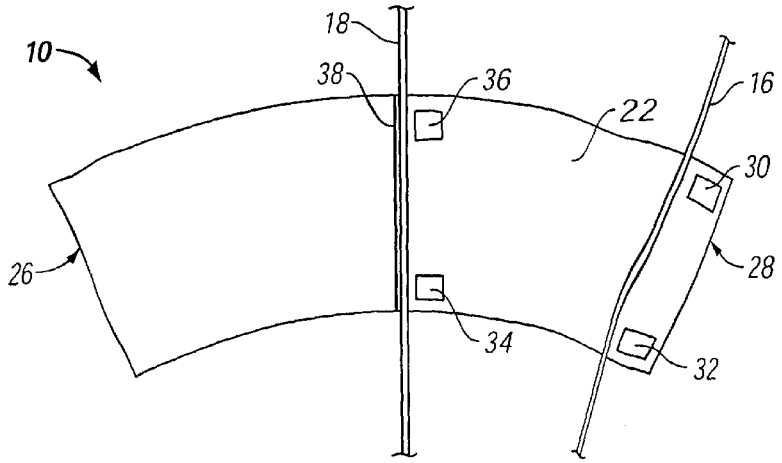
Figure 6:
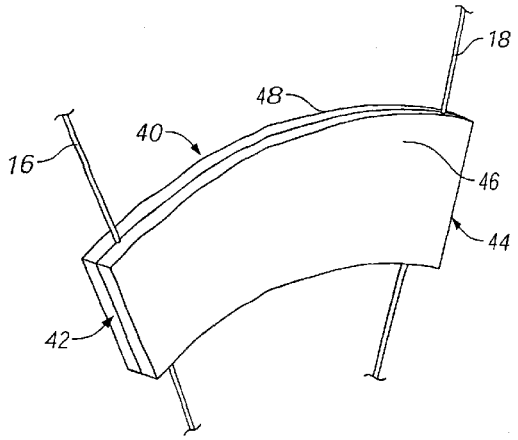
Figure 6A:
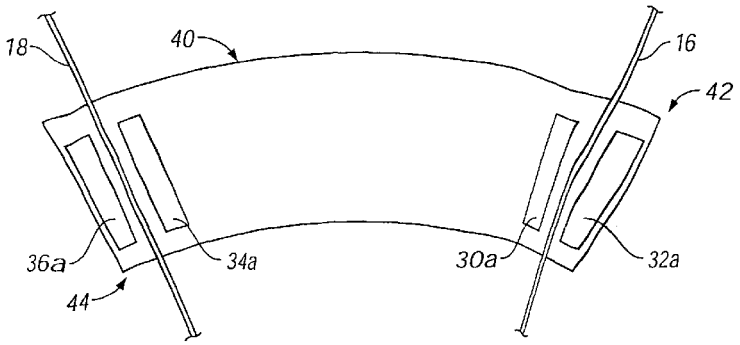
Figure 7:
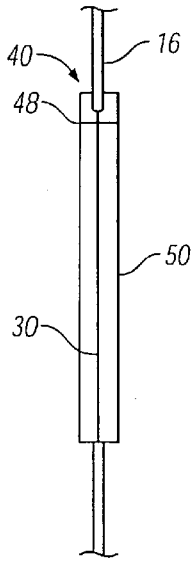
Figure 8:
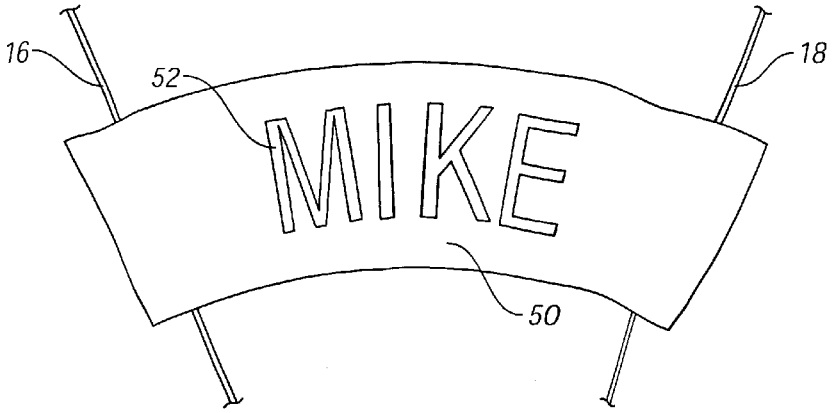
Figure 9:
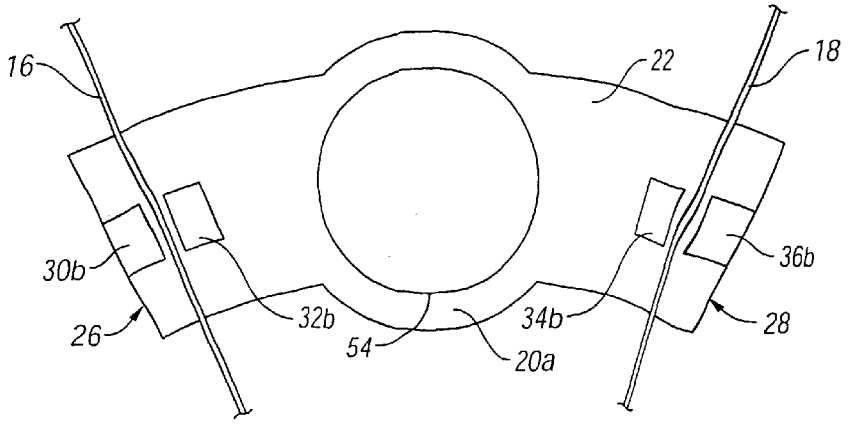
Figure 10:
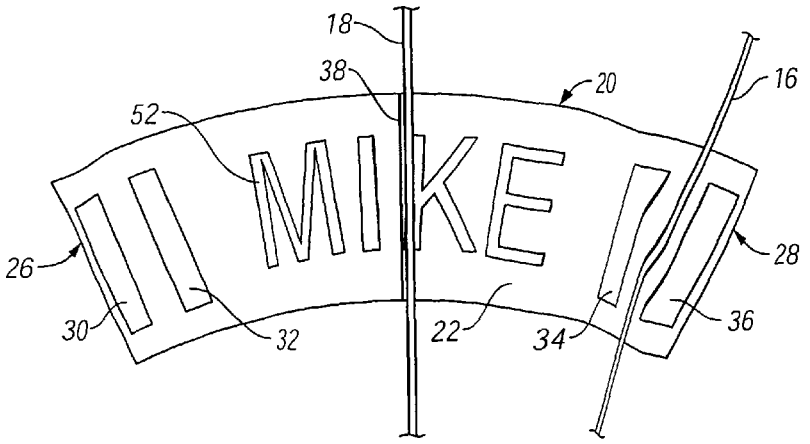

FIG. 9 depicts the top view of FIG. 6 showing a first and second two-sided adhesive strip 30*a*, 32*a* disposed on the first side and on the first attachment end 26. A third and fourth two-sided adhesive strip 34*a*, 36*a* are disposed on the first side and on the second attachment end 28. The first two-sided adhesive strip 30 is proximate to the second two-sided adhesive strip 32*a*. The third two-sided adhesive strip 34*a* is proximate to the fourth two-sided adhesive strip 36*a*. In this embodiment, the first two-sided adhesive strip 30*a* secures to the second two-sided adhesive strip 32*a* around spoke 16. The third two-sided adhesive strip 34*a* secures to the fourth two-sided adhesive strip 36*a* around spoke 18. A sheet plastic pigment 54 can be embedded in the sheet plastic. FIG. 9 also shows that the personal identification panel can have a circular shape 20*a*.

While only a few embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention is provided for illustration only, and not for the purpose of limiting the invention as defined by the appended claims and their equivalents.

What is claimed is:

1. A personal identification panel for vehicle having at least one wheel having a first spoke and a second spoke, comprising:

a. a rigid personal identification panel area comprising
   i. a first side;
   ii. a second side;
   iii. a first attachment end for attachment to the first spoke;
   iv. a second attachment end for attachment to the first spoke; and
   v. wherein said a rigid personal identification panel area has a thickness of $1/32^{th}$ inch;

b. a first adhesive strip and a second adhesive strip disposed on the first side and on the first attachment end, wherein the first adhesive strip is proximate to the second adhesive strip c. a third adhesive strip and a fourth adhesive strip disposed the first side and on the second attachment end, wherein the third adhesive strip is proximate to the fourth adhesive strip;

d. a fold formed in said rigid display, wherein said rigid display wraps around the second spoke, in the direction of wheel rotation, and said first adhesive strip adheres to said fourth adhesive strip, and said second adhesive strip adheres to said third adhesive strip and said second spoke nestles within said fold and said first spoke is disposed between the adhered first and fourth adhesive strips and the adhered second and third adhesive strips.

2. The personal identification panel of claim 1, wherein the adhesive strips are square patches.

3. The personal identification panel of claim 1, wherein said vehicle is selected from the group consisting of bicycle, tricycle, unicycle, baby carriage, trailer, motorcycle, scooter, shopping cart, and wagon.

4. The personal identification panel of claim 1, wherein said display device has a length between 4 inches and 13 inches and a width between 3.5 inches and 5 inches.

5. The personal identification panel of claim 4, wherein the wheel has a diameter between 26 inches and 27 inches and said display device has a length of 12.57 inches and a width of 3.5 inches.

6. The personal identification panel of claim 4, wherein the wheel has a diameter of 24 inches and said personal identification panel has a length of 11 inches length and a width of 3 inches.

7. The personal identification panel of claim 4, wherein the wheel has a diameter between from 16 inches to 20 inches and said personal identification panel has a length of 8 inches and a width of 2.5 inches.

8. The personal identification panel of claim 1, wherein the rigid personal identification panel area is circular.

9. The personal identification panel of claim 1, wherein the rigid personal identification panel area is crescent shaped and has an arc between 30 degrees and 90 degrees.

10. The personal identification panel of claim 1, wherein the rigid personal identification panel area has an arc of 60 degrees.

11. The personal identification panel of claim 1, wherein said rigid personal identification panel area is sheet plastic having a holding power of at least 1 lb per square inch and a withstand shear of 60 pounds per square inch.

12. The personal identification panel of claim 1, wherein the rigid personal identification panel area is a material selected from the group consisting of polypropylene, Mylar, and acrylic.

13. The personal identification panel of claim 1, further comprising a surface pigment disposed on the surface of the rigid personal identification panel area.

14. The personal identification panel of claim 13, wherein said surface pigment is a member of the group consisting of lettering and logos.

15. The personal identification panel of claim 13, wherein said surface pigment is selected from the group consisting of phosphorescent, fluorescent, luminescent, and opaque.

16. The personal identification panel of claim 13, further comprising a sheet plastic pigment embedded in the sheet plastic.

17. The personal identification panel of claim 11, wherein the sheet plastic pigment is disposed on said sheet plastic.

18. A personal identification panel for vehicle having at least one wheel having a first spoke and a second spoke, comprising:

a. a rigid personal identification panel area comprising
   i. a first side;
   ii. a second side;
   iii. a first attachment end for attachment around the first spoke;
   iv. a second attachment end for attachment around the first spoke; and
   v. wherein said rigid personal identification panel area has a thickness of $1/32^{th}$ inch;

b. a fold formed in said rigid personal identification panel area, wherein said rigid display area wraps around the second spoke, and is oriented in the direction of wheel rotation;

c. a first adhesive strip and a second adhesive strip disposed on the first side and on the first attachment end;

d. a third adhesive strip and a fourth adhesive strip disposed on the first side proximate to each other and to the fold; and e. wherein the first attachment end of the rigid personal identification panel area folds around second spoke and secures to the first and second adhesive strips on one side of said first spoke and secures to said third and fourth adhesive strips on the other side of the first spoke such that said second spoke nestles within said fold.

19. A personal identification panel for a vehicle having at least one wheel having a first spoke and a second spoke, comprising:

a. a rigid display support comprising
   i. a first support end;
   ii. a second support end;
   iii. a first support side;
   iv. a second support side, and
   v. wherein said rigid display support has a thickness of 1/32th inch;

b. a first adhesive strip and a second adhesive strip disposed on the first support side and on the first support end;

c. a third adhesive strip and a fourth adhesive strip disposed on the first support side and on the second support end; and d. a rigid display top for attaching to said rigid display support, forming a laminate, and wherein said first spoke is disposed between said first and second adhesive strips and between said rigid display top and said rigid display support, and said second spoke is disposed between said third and fourth adhesive strips between said rigid display top and said rigid display support.

* * * * *

UNITED STATES PATENT AND TRADEMARK OFFICE

CERTIFICATE OF CORRECTION

PATENT NO. : 6,725,590 B1
DATED : April 27, 2004
INVENTOR(S) : Mike Slusher

It is certified that error appears in the above-identified patent and that said Letters Patent is hereby corrected as shown below:

The title page as been deleted, and substitute the title page with the attached title page.

In the drawings, figures 1, 2, 3, 4, 5, 6, 6A, 7, 8, 9, and 10 should be replaced with the following attached figures 1, 2, 3, 4, 5, 6, 6A, 7, 8, 9 and 10.

Signed and Sealed this

Thirty-first Day of August, 2004

JON W. DUDAS
*Director of the United States Patent and Trademark Office*

(12) United States Patent
Slusher

(10) Patent No.: US 6,725,590 B1
(45) Date of Patent: Apr. 27, 2004

(54) PERSONAL IDENTIFICATION PANEL FOR BIKE

(75) Inventor: Mike Slusher, 2911 Brookshire Dr., Grapevine, TX (US) 76051

(73) Assignee: Mike Slusher, Grapevine, TX (US)

( * ) Notice: Subject to any disclaimer, the term of this patent is extended or adjusted under 35 U.S.C. 154(b) by 0 days.

(21) Appl. No.: 10/365,175

(22) Filed: Feb. 12, 2003

Related U.S. Application Data

(60) Provisional application No. 60/357,596, filed on Feb. 15, 2002.

(51) Int. Cl.[7] ..... G09F 21/04

(52) U.S. Cl. ..... 40/590; 40/587; 40/594; 40/630; 40/672

(58) Field of Search ..... 40/590, 587, 594, 40/625, 628, 630, 672

(56) References Cited

U.S. PATENT DOCUMENTS 1,182,753 A * 5/1916 Clencie ..... 40/587
3,820,852 A * 6/1974 Kennedy ..... 40/587
3,887,268 A * 6/1975 Golden et al. ..... 40/613
5,246,517 A * 9/1993 Watson ..... 40/594
5,349,470 A * 9/1994 Alexander ..... 40/587
5,619,815 A * 4/1997 Greene ..... 40/587

* cited by examiner

*Primary Examiner*—Gary Hoge
(74) *Attorney, Agent, or Firm*—Wendy Buskop; Buskop Law Group, P.C.

(57) ABSTRACT

The invention is a personal identification panel for vehicles having at least one wheel with at least two spokes made of a rigid personal identification panel area with a thickness of 1/32th having a first side, a second side, a first attachment end for folding over the first spoke, a second attachment end for folding over the second spoke, a first adhesive strip and a second adhesive strip disposed on the first side and on the first attachment end, wherein the first adhesive strip is proximate to the second adhesive strip and the first adhesive strip secures to the second adhesive strip, and a third adhesive strip and a fourth adhesive strip disposed the first side and on the second attachment end, wherein the third adhesive strip is proximate to the fourth adhesive strip and the third adhesive strip secures to the fourth adhesive strip.

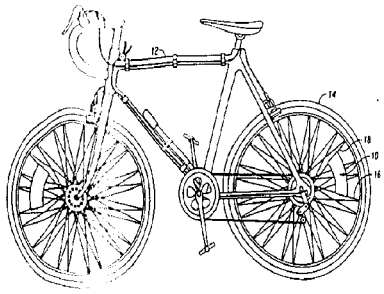

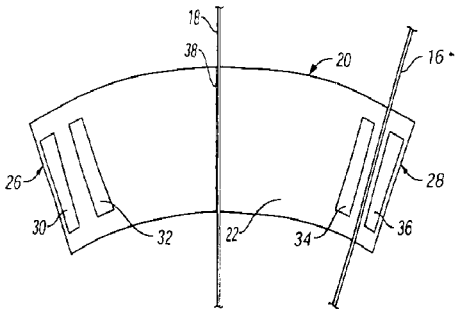

19 Claims, 11 Drawing Sheets